US007234182B2

(12) United States Patent
Miller et al.

(10) Patent No.: US 7,234,182 B2
(45) Date of Patent: Jun. 26, 2007

(54) ASSIST DEVICE FOR GETTING INTO AND OUT OF SITTING OR RECLINED POSITIONS

(75) Inventors: Jan Miller, Logan, UT (US); Troy Miller, Logan, UT (US)

(73) Assignee: Standers, Inc., Logan, UT (US)

( * ) Notice: Subject to any disclaimer, the term of this patent is extended or adjusted under 35 U.S.C. 154(b) by 0 days.

(21) Appl. No.: 10/973,153

(22) Filed: Oct. 26, 2004

(65) Prior Publication Data

US 2006/0085917 A1 Apr. 27, 2006

Related U.S. Application Data

(63) Continuation of application No. 10/764,903, filed on Jan. 26, 2004, now Pat. No. 7,032,265, which is a continuation-in-part of application No. 09/150,268, filed on Sep. 9, 1998, now abandoned.

(51) Int. Cl.
*A47B 23/02* (2006.01)

(52) U.S. Cl. ..... 5/662; 5/507.1

(58) Field of Classification Search ..... 5/507.1, 5/658, 503.1, 662; 108/49, 141, 42, 135; 297/150, 160

See application file for complete search history.

(56) References Cited

U.S. PATENT DOCUMENTS 1,862,237 A * 6/1932 Pepler ..... 108/49
2,612,422 A * 9/1952 Sarkus ..... 108/141
4,724,559 A 2/1988 Bly et al.
5,359,741 A * 11/1994 Lang ..... 5/507.1
5,400,450 A 3/1995 Leoutsakos
5,448,791 A 9/1995 Brown
5,507,044 A 4/1996 Williamson et al.
5,586,352 A * 12/1996 O'Brien et al. ..... 5/662
5,787,530 A 8/1998 Brix
6,138,301 A 10/2000 Battison
6,311,942 B1 11/2001 Rotter et al.
6,401,280 B1 6/2002 Baker

* cited by examiner

*Primary Examiner*—Patricia Engle
*Assistant Examiner*—Fredrick Conley
(74) *Attorney, Agent, or Firm*—Stoel Rives LLP

(57) ABSTRACT

An assist device to help a user move from a sitting or reclined position to an upright position, and vice versa, with a functional tray. The assist device includes a base, a receiver, a handle, and a tray. The base may be positioned between a mattress and a box spring, or a couch frame and a couch cushion, or the like. The handle includes various gripping sections. The handle pivotably couples to the receiver and the tray rotatably couples to the handle. The tray moves from a closed position to an open position, or a usable position, to allow the user to place objects thereon, or to use the tray for any other purpose.

18 Claims, 4 Drawing Sheets

ASSIST DEVICE FOR GETTING INTO AND OUT OF SITTING OR RECLINED POSITIONS

CROSS-REFERENCE TO RELATED APPLICATIONS

This application claims the benefit of U.S. patent application Ser. No. 10/764,903 entitled "Assist Device for Getting into and out of Sitting or Prone Positions on Bed and Similar Furniture", filed on Jan. 26, 2004 for Troy Miller, which is a continuation-in-part of and claims priority to U.S. patent application Ser. No. 09/150,268 also entitled "Assist Device for Getting into and out of Sitting or Prone Positions on Bed and Similar Furniture", filed on Sep. 9, 1998 for Troy Miller.

FIELD OF THE ILLUSTRATED EMBODIMENTS

This invention relates generally to the field of medical and ambulatory assist devices and equipment, and more specifically, to an assist device and tray for assisting individuals with disabilities to get up from and recline into sitting and/or prone positions on a bed or other object.

BACKGROUND

Devices and methods for assisting people to get up from and recline into sitting and/or prone positions are well known in the art. These devices tend to fall into two broad categories. The first general category consists of devices that are roughly fixed to a standard bed or like piece of furniture. The second general category consists of devices that mechanically raise and lower. These include beds and like pieces of furniture that contain motors which are designed to raise and lower the respective furniture to allow a person to either stand up, sit or lie down.

In most instances, the first general category of devices has some sort of a handle that is attached to a base. The base in turn anchors in some manner to a bed or like piece of furniture. The handle extends up above the level of the bed or other piece of furniture allowing the user to grab the handle to either get up from and/or recline into the bed.

While adequate for a number of applications, the type of devices just described also includes a number of disadvantages. For example, most of these devices have handles that are immovably fixed to the base. This can cause the device to be awkward to store or transport. In order to overcome this problem the device might have to be disassembled which might result in lost or damaged parts.

A further disadvantage is that the handle of most comparable devices is that they are awkward in shape and difficult for individuals using the device to grab a hold of and to adjust their hand positions once they have grabbed the handle. That is, the handles of most devices do not resemble any type of device that the users are familiar with or used to using, or they offer no advantage to the user to manipulate his or her hand positions for ease of use.

An additional disadvantage of the handle on the first category of devices is that they are small and do not offer the user a large surface upon which to place his or her hand or arm. Thus, as set forth above, the handle can be difficult to grab and it does not offer any significant advantage over simply pushing him or herself up.

Still a further disadvantage of the first category of devices is that the attaching means generally used are specific to a particular type of bed or like furniture. Thus, the device will not be able to be used on all or most beds or like pieces of furniture.

Still another disadvantage of this first category of devices is that the means to attach the device to the bed or other piece of furniture does not secure the device in place. Thus, the device can move or become unstable and even dangerous during use.

While also adequate for a number of applications, the second general category of devices described above also include a number of disadvantages. For example, the cost of such devices is prohibitive for most individuals, especially those on fixed incomes. In most instances, these devices cost thousands of dollars and are out of reach of most individuals who find themselves in need of such devices.

Another disadvantage of this type of device is that they are somewhat dangerous when in operation. That is, the mechanical device generally lifts a person to a sitting or standing position at which point there is no further support for the individual. Most of these devices do not have any bars or handles that a person can grab a hold of as they attempt to sit or stand. When the device reaches its highest point, the person operating the device must be ready and able to sit or stand on their own; there is no going back. If the person is not ready at that instant, there is a strong likelihood that they might stumble and fall.

A further disadvantage of these devices is that they are power dependent. If there is a power outage the device will not operate. As is obvious, at the time when a power outage occurs there may be a critical need for an injured or infirm person to get help to avoid problems that might be associated with the power outage such as the ability to heat or cool a home. However, it is precisely at this time that the device will not work, thus rendering the user vulnerable to such conditions.

Regardless of the prior types of assist devices, generally once attached to the bed, they take up a lot of space, and besides the utility of helping a person out of the bed, they are not of much use, they get in the way if a user would like to use a bed tray, and they are often times unattractive.

From the foregoing discussion, it should be apparent that a need exists for an apparatus that allows a user to easily attach the assist device to a bed or furniture, and a tray to allow the user to use the assist device while not being used to raise the individual. Beneficially, such an apparatus would make life simpler for those who need to use assist devices, increase functionality of the assist device, improve appearance, and increase the types of activities that the disabled can participate in.

BRIEF SUMMARY OF THE ILLUSTRATED EMBODIMENTS

The present invention has been developed in response to the present state of the art, and in particular, in response to the problems and needs in the art that have not yet been fully solved by currently available assist devices. Accordingly, the present invention has been developed to provide an apparatus for assisting users to easily move from a prone or reclined position to a sitting or standing position, and vice versa, that overcomes many or all of the above-discussed shortcomings in the art.

The assist device in one embodiment, is configured to include a base, which is to be positioned between a first surface and a second surface, such as a mattress and a box spring, or a couch frame and a couch cushion, a receiver coupled to the base to connect to a handle, and a tray. The handle is configured to pivotably couple to the receiver and the tray rotatably couples to the handle. The tray configured to allow the user to place objects thereon, or to use the tray for any other purpose. In one embodiment, the receiver is adjustable to allow height adjustment.

The handle, in another embodiment, includes first and second gripping sections. The tray may be shaped to match a shape of a space between the first and second gripping sections, and it may be configured to fit between the first and second gripping sections when in the closed position. In yet another embodiment, a tray bracket may be used to attach the tray to the handle.

The tray bracket rotates about the handle to move the tray from the closed position to an open position. A locking means, such as a spring-loaded pin, may be used to lock the tray in the open and closed positions.

In still another embodiment, the handle may couple the receiver via a movable joint to allow the handle to rotate to a usable position, such as the open position. The movable joint may include at least one notch to lock the handle in a fixed position.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained can be appreciated, a more specific description of the invention briefly described above will be rendered y reference to the specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE EMBODIMENTS

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
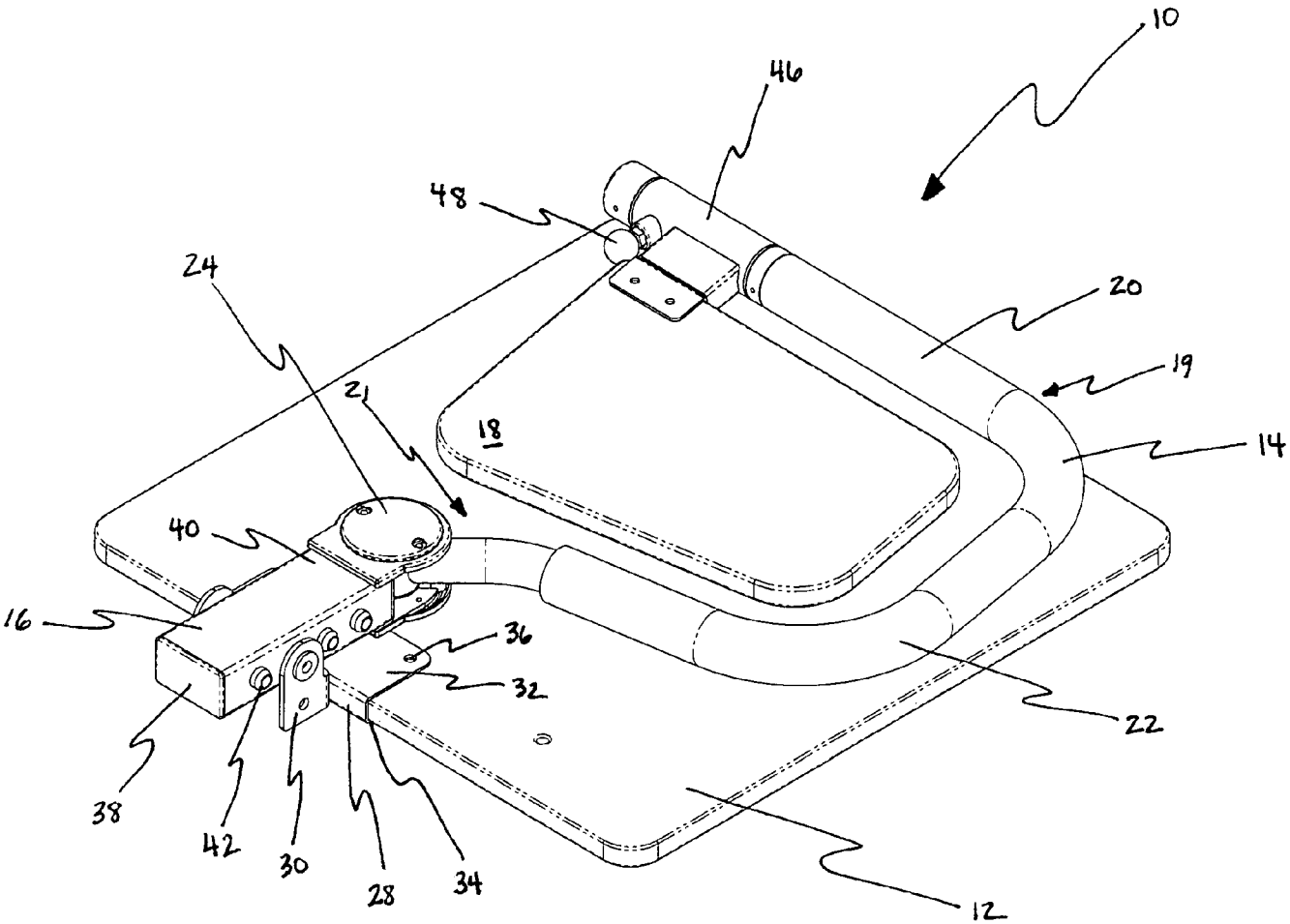
FIG. 1 illustrates an assist device in a folded position for easy storage and transportation according to one embodiment of the present invention.

FIG. 1 depicts an assist device 10 in a folded position according to one embodiment of the present invention. The assist device 10 of the present invention includes a base 12, a handle 14, a receiver 16, and a tray 18. The base 12 is configured to be positioned between a first surface and a second surface, such as a box spring and a mattress, or a sofa frame and a seat cushion. The handle 14 is configured to be held by a user and is securely fastened to the base 12 via the receiver 16. The tray 18 rotatably couples to the handle 14 and is configured to allow the user to place objects thereon, or to use the tray 18 for any other purpose.

The base 12 is advantageously designed to be large enough to provide a firm and stable base for the operation of the assist device 10. Advantageously, the base 12 is constructed of rigid non-flexing material such as wood. Other materials such as wood composites, plastics, polymers, steel, aluminum, and the like, are also contemplated and fall within the purview and scope of this invention.

Similarly, the handle 14 is designed of a firm and rigid material to prevent flexing and bending when the user applies pressure thereto. The handle 14 may be any type of hard and rigid material, such as plastic, steel, composites, wood, and the like.

The handle 14 includes first and second ends 19 and 21, respectively. Portions of the first end 19 of the handle 14 are coated, or covered, with a material or substance to prevent the user's hand from slipping during use. One skilled in the art will readily recognize that the coating or covering can be made of numerous materials to accomplish the end of creating a slip free surface and all the coatings and covering are contemplated in this patent. The second end 21 of the handle 14 pivotably connects to the receiver 16 at a movable joint 24.

The first end 19 of the handle 14 comprises first and second gripping sections 20 and 22. The first and second gripping sections 20 and 22 allow the user to hold the assist device 10 from a preferred, or more comfortable, position.

The second end 42 of the handle 14 couples the receiver 16 via the movable joint 24. The movable joint 24 is configured to move the handle 14 to a usable position. In one embodiment, the movable joint 24 comprises at least one notch 26 (See FIG. 2) configured to lock the handle in a fixed position. Preferably, the movable joint 24 includes a plurality of notches 26 to allow the user to position the handle 14 and tray 18 in a variety of positions to allow the user to adjust the assist device 10 to particular positional preferences.

The receiver 16 connects to the base 12 via a bracket. As illustrated, the receiver 16 may be configured to fold towards the base 12 for easy storage and transportation. The bracket includes both a u-shaped member 28 and a receiving member 30. The u-shaped member 28 includes a top and bottom flange 32 and 34. The top and bottom flanges 32 and 34, respectively, are transposed by a plurality of holes or perforations 36. One skilled in the art will immediately recognize that the plurality of holes or perforations 36 are designed to line up with a plurality of holes or perforations in the base 12 for the purposes of anchoring the u-shaped member 28 to the base 12.

The receiver 16 includes first and second ends 38 and 40, respectively. The second end 40 of the receiver 16 removably anchors to the receiving member 30. One skilled in the art will recognize that the height of the handle 14 relative to the base 12 can be adjusted by moving the receiver 16 relative to the receiving member 30. Specifically, pins 42 protrude from the receiver 16 into receiving holes 44 of the receiving member 30. The pins 42 can be removed and reinserted into the receiving holes 44 at any location along a length of the receiver 16.

One skilled in the art will also recognize that other adjustments means are envisioned, specifically, the pins 42 may be spring loaded and require the user to depress the pins 42 into the receiver 16 before height adjustment can be accomplished. By allowing the height of the handle 14 to be adjusted, the handle 14 can be configured to accommodate all types of beds or like furniture as well as the particular individual needs of the user.

In the illustrated folded position, the handle 14 can be folded towards the base 12 and stored away in a more compact position without requiring significant disassembly of the bolts or requiring removal of the handle 14 from the base 12 as is required in prior art designs.

Figure 2:
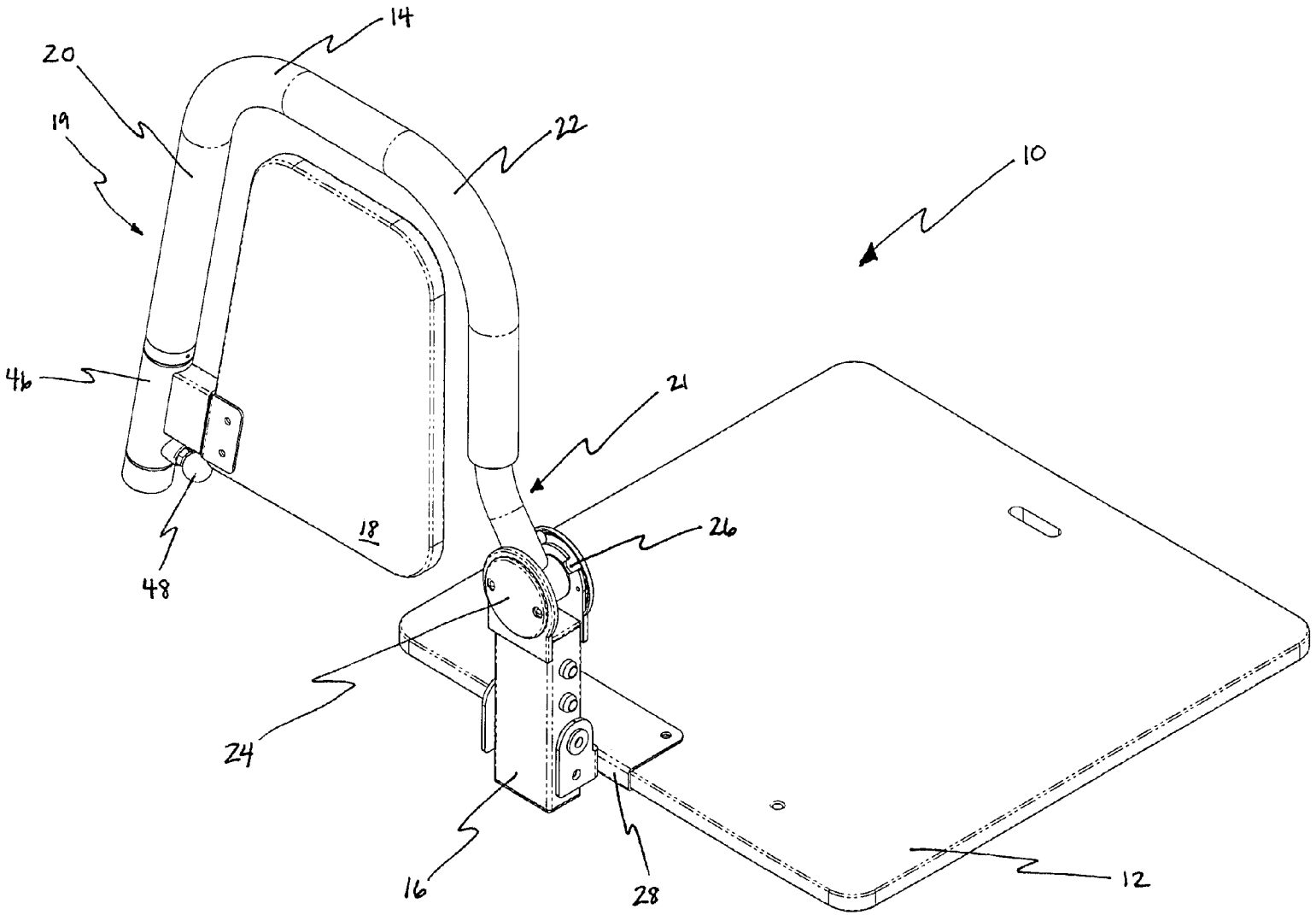
FIG. 2 illustrates an assist device in an unfolded position according to one embodiment of the present invention.
Figure 3:
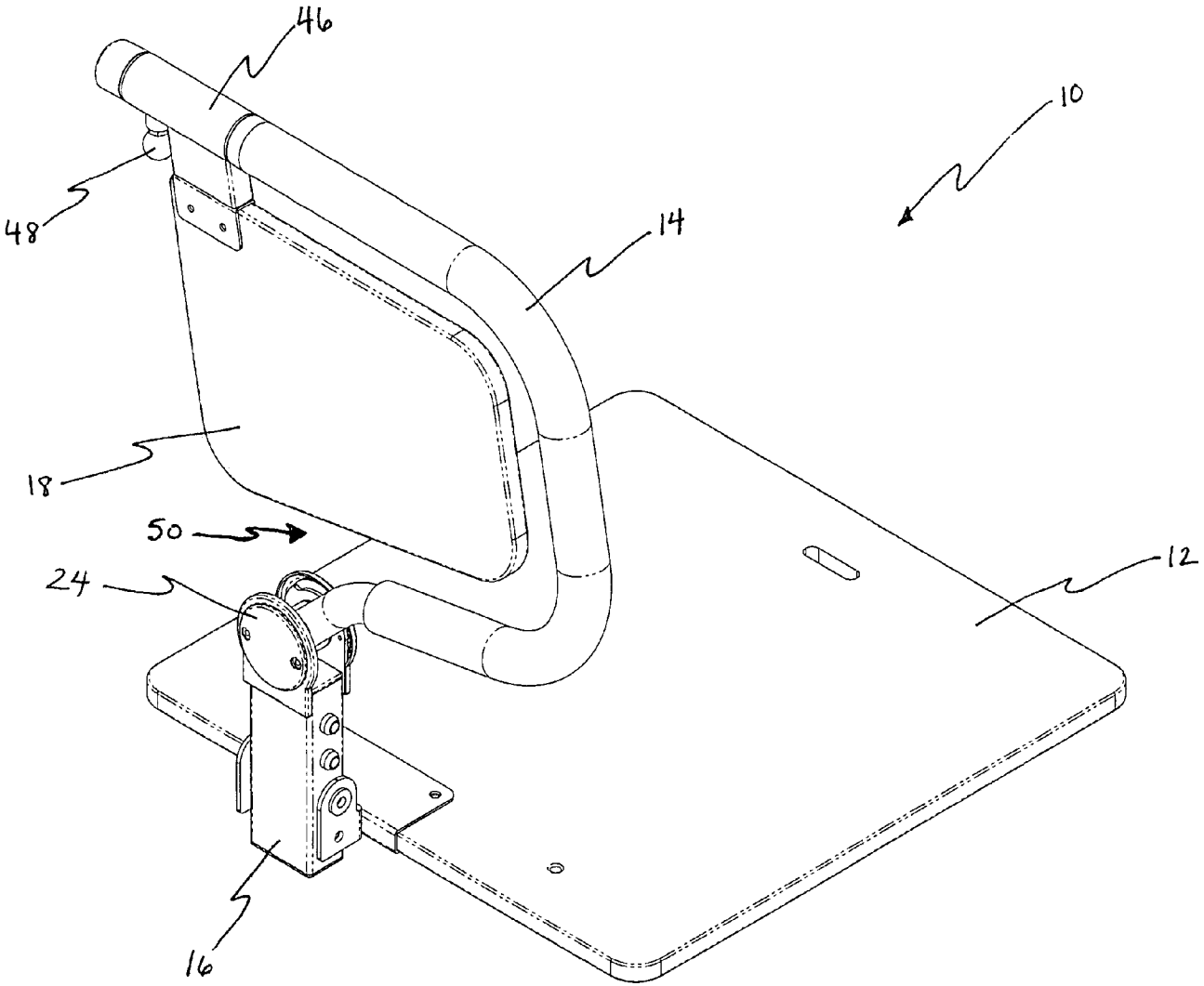
FIG. 3 illustrates an assist device with a handle positioned in a usable configuration, with a tray in a closed position, according to one embodiment of the present invention.
Figure 4:
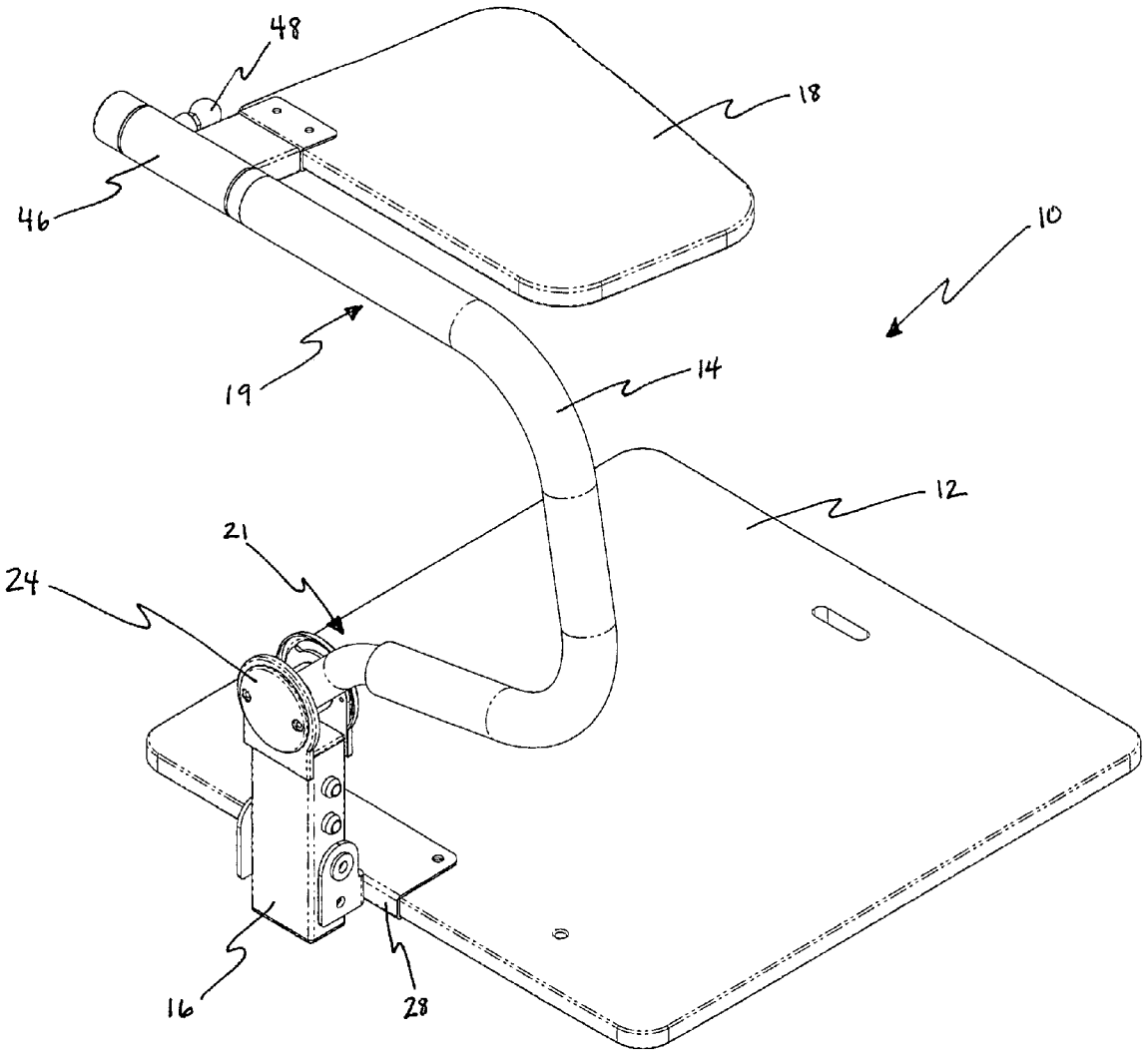
FIG. 4 illustrates an assist device with a handle and tray in fully usable positions according to one embodiment of the present invention.

FIGS. 2–4 illustrate the assist device 10 in a usable position, with the tray 18 in usable positions. In one embodiment, a tray bracket 46 attaches the tray 18 to the handle 14. The tray bracket 46 is configured to rotate about the handle 14 to move the tray 18 from the closed position to the usable position.

A locking means 48 may be used to prevent the tray 18 from unintended movement. In one illustrated embodiment, locking means 48 is a spring loaded pin that requires the user to press, or depress, to release the tray 18 from one position. As the tray 18 moves to a new position, the pin locks the tray 18. One skilled in the art will recognize that the spring-loaded pin is only one means for locking the tray 18. Any type of locking means is certainly envisioned.

To facilitate storage, transportation, and ease of movement when not in use, the tray 18 is configured to fit between the first and second gripping sections 20 and 22 when in the closed position. In a preferred embodiment, to maximize the size of the tray 18, the tray 18 is shaped to match a shape of a space 50 between the first and second gripping sections 20 and 22.

In operation, once the device 10 has been properly positioned, the user can use the same by grasping the handle 14 and, during sitting, can apply the necessary pressure to allow himself or herself to ease into a sitting position. The user can remain in contact with the handle 14 and swing his or her legs up onto the bed into the desired position. Conversely, a user desiring to sit up from a prone position may likewise grasp the handle 14 and, by applying increasing pressure, pull them self into a sitting position, while at the same time swinging their legs off the edge of the bed. From a sitting position, the user can then apply the necessary pressure to pull them selves from a sitting to a standing position. One skilled in the art will recognize that the user may hang onto the handle until they have attained enough stability of confidence to begin walking away from the bed chair or like piece of furniture.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An assist device to assist a user into and out of a reclined position, the device comprising:

a base, configured to be positioned between a first surface and a second surface;

a receiver coupled to the base;

a support handle, pivotably coupled to the receiver, and configured to provide support to the user who applies pressure thereon, into and out of a reclined position, the handle capable of being in an upright position relative to the base, the handle further comprising first and second gripping sections which reside in a common plane; and a tray, rotatably coupled to the handle from an open position where the tray is substantially parallel to the base when the handle is in the upright position to a closed position where the tray is no longer parallel to the base when the handle is in the upright position and the tray is substantially coplanar with the common plane when in the closed position.

2. The assist device according to claim 1, wherein the first surface is a box spring and the second surface is a mattress.

3. The assist device according to claim 1, wherein the first surface is a couch frame and the second surface is a couch sitting cushion.

4. The assist device according to claim 1, wherein the movable joint comprises at least one notch configured to lock the handle in a fixed position.

5. The assist device according to claim 1, further comprising a tray bracket, the tray bracket configured to rotate about the handle to move the tray from the closed position to the open position.

6. The assist device according to claim 5, wherein the tray bracket further comprises a locking means configured to lock the tray in the open and closed positions.

7. The assist device according to claim 6, wherein the locking means is a spring loaded pin.

8. The assist device according to claim 1, wherein the handle couples the receiver via a movable joint the joint configured to move the handle to a usable position.

9. The assist device according to claim 1, wherein the tray is shaped to match a shape of a space between the first and the second gripping sections.

10. An assist device to assist a user into and out of a reclined position, the device comprising:

a base configured to be positioned between a first and second surface;

a receiver pivotably coupled to the base;

a support handle coupled the receiver, the handle capable of being in a folded position adjacent the base, an upright position spaced away from the base, and a gripping position spaced away from the base and configured to be toward the user, the support handle configured to provide support to the user who applies pressure thereon, into and out of a reclined position;

a movable joint pivotably coupling the handle to the receiver, such that the handle pivots from the upright position to the gripping position; and a tray, rotatably coupled to the handle, such that the tray may be in an unfolded position substantially parallel to the base when the handle is in the upright position, and the tray may rotate to a closed position substantially perpendicular to the base when the handle is in the upright position;

wherein the handle comprises first and second gripping sections which reside in a common plane, such that the tray is substantially coplanar with the common plane when in the closed position.

11. An assist device to assist a user into and out of a reclined position, the device comprising:

a base, configured to be positioned between a first surface and a second surface;

an adjustable receiver pivotably coupled to the base;

a support handle, pivotably coupled to the receiver, and configured to provide support to the user who applies pressure thereon, into and out of a reclined position; and a tray having a width and a length, the tray rotatably coupled to the handle, configured to allow the user to place objects thereon;

wherein the adjustable receiver enables the handle to be in an upright position spaced away from the base and a folded position adjacent the base and wherein the support handle comprises a first gripping section which extends along the length of the tray and a second gripping section which extends along the width of the tray, such that the tray does not extend beyond distal ends of the first and second gripping sections.

12. The assist device according to claim 11, wherein the movable joint comprises at least one notch configured to lock the handle in a fixed position.

13. The assist device according to claim 11, wherein the first surface is a box spring and the second surface is a mattress.

14. The assist device according to claim 11, wherein the first surface is a couch frame and the second surface is a couch sitting cushion.

15. The assist device according to claim 11, wherein the handle couples the receiver via a movable joint, the joint configured to move the handle to a usable position.

16. The assist device according to claim 11, further comprising;

a tray bracket rotatably coupled to the handle, and configured to rotate about the handle to move the tray from a closed position to an open position; and a locking means configured to lock the tray in the open and closed positions.

17. The assist device according to claim 16 wherein the locking means is a spring loaded pin.

18. The assist device according to claim 11, wherein the tray fits between the first and second gripping sections when the closed position, such that the tray is substantially coplanar with the first and second gripping portions.

* * * * *

UNITED STATES PATENT AND TRADEMARK OFFICE

CERTIFICATE OF CORRECTION

PATENT NO. : 7,234,182 B2
APPLICATION NO. : 10/973153
DATED : June 26, 2007
INVENTOR(S) : Miller et al.

It is certified that error appears in the above-identified patent and that said Letters Patent is hereby corrected as shown below:

Column 3, Line 55 reads, ". . . will be rendered y refer-. . ." which should read --. . . will be rendered by refer-. . .--

Column 6, Line 5 reads, ". . . pull them self into a . . ." which should read --. . . pull themself into a . . .--

Column 6, Line 8 reads, ". . . pull them selves from a sitting . . ." which should read --. . . pull themselves from a sitting . . .--

Column 6, Line 59 reads, ". . . via a movable joint the joint . . ." which should read --. . . via a movable joint, the joint . . .--

Column 7, Line 2 reads, ". . . handle coupled the receiver, the . . ." which should read --. . . handle coupled to the receiver, the . . .--

Column 8, Line 1 reads, ". . . adjacent the base and wherein . . ." which should read --. . . adjacent the base, and wherein . . .--

Signed and Sealed this

Twenty-ninth Day of July, 2008

JON W. DUDAS
*Director of the United States Patent and Trademark Office*